United States Patent [19]

Tapojärvi

[11] Patent Number: 4,589,350

[45] Date of Patent: May 20, 1986

[54] SHELF ASSEMBLY

[76] Inventor: Eero Tapojärvi, Perttiläntie 14, 08500 Lohja as, Finland

[21] Appl. No.: 598,304

[22] PCT Filed: Jul. 16, 1982

[86] PCT No.: PCT/FI82/00027

§ 371 Date: Mar. 5, 1984

§ 102(e) Date: Mar. 5, 1984

[87] PCT Pub. No.: WO84/00289

PCT Pub. Date: Feb. 2, 1984

[30] Foreign Application Priority Data

Jan. 26, 1981 [FI] Finland ..... 810211

[51] Int. Cl.[4] ..... A47B 47/00

[52] U.S. Cl. ..... 108/111; 108/153

[58] Field of Search ..... 108/111, 159, 153, 154, 108/155, 110, 107; 312/257 A; 52/585; 403/408, 4, 292

[56] References Cited

U.S. PATENT DOCUMENTS

| | | | |
|---|---|---|---|
| Re. 28,244 | 11/1974 | Evans | 108/111 X |
| Re. 28,293 | 1/1975 | Bustos | 108/111 X |
| 327,592 | 10/1885 | Reed | 108/107 X |
| 951,475 | 3/1910 | Gerberich | 108/107 |
| 2,377,156 | 5/1945 | Kimbell | 403/292 X |
| 2,838,144 | 6/1958 | MacDonald | 52/585 X |
| 3,786,611 | 1/1974 | Brown et al. | 52/585 X |

FOREIGN PATENT DOCUMENTS

| | | | |
|---|---|---|---|
| 1037909 | 9/1978 | Canada | 108/111 |
| 1575193 | 7/1969 | France | 108/159 |
| 605686 | 8/1960 | Italy | 52/585 |

*Primary Examiner*—William E. Lyddane
*Assistant Examiner*—José V. Chen
*Attorney, Agent, or Firm*—Andrus, Sceales, Starke & Sawall

[57] ABSTRACT

The invention relates to a shelf assembly, comprising at least two parallel and horizontal supporting crossbars (2) mounted side by side on a support structure or frame (1) as well as a rectangular, elongated shelf board (3) mounted on top of said crossbars, the latter extending crosswise relative to said shelf board. The object is to provide a shelf assembly which is made of structural elements, exclusively of wood, is of a simple design, sturdy, readily extensible and aethestically neat. According to the invention, a shelf board (3) is fastened by the ends thereof in slots (5, 6) formed in crossbars (2) and shelf boards, the slots of said crossbars opening at an angle of 45° obliquely upwards perpendicularly to the crossbar and the slots of said shelf board opening at an angle of 45° obliquely downwards and outwards perpendicularly to said board as viewed from the end thereof.

3 Claims, 3 Drawing Figures

SHELF ASSEMBLY

The present invention relates to a shelf assembly defined in the preamble of the annexed claim.

BACKGROUND OF THE INVENTION

Mounting of shelf boards on shelf supporting crossbars leads to problems in element-structured, free-standing shelf assemblies which are held together by structural elements, i.e. bearing crossbars and shelf boards and which can be extended into larger shelf assemblies. Coupling of shelf boards together for holding the assembly intact creates further problems. For example, in wood construction shelves, the coupling elements comprise screws, consoles and the like metal fasteners. When a shelf assembly is to be made of purely natural material, e.g. wood, the use of metal fasteners is out of the question. A further drawback involved in the use of metal fasteners is that the fitting, mounting and usually also the use thereof requires special tools. Metal fasteners may cause trouble when used e.g. in display racks of clothing stores since thinner clothes easily grab the generally sharp edges of metal fasteners and thus tear themselves easily. In terms of aesthetics, metal fasteners are not genereally desirable.

SUMMARY OF THE INVENTION

An object of the invention is to provide a shelf assembly which is adapted to be manufactured exclusively from wood and which has no metal fasteners at all. Another object of the invention is to provide an entirely wood-constructed shelf assembly which is element-structured and thus adapted to be extended and expanded when necessary. A further object of the invention is to provide a solid, practical shelf assembly which is of simple wooden construction and has aesthetically neat appearance as well as meets the above requirements.

As for the characterizing features of the invention, reference is made to the annexed claims.

By virtue of the invention, shelf boards can be coupled endwise to supporting crossbars in a manner that the end of a preceding shelf board rests upon a crossbar covering not more than half of it, while the end of a following shelf board rests upon the same supporting crossbar and correspondingly covers not more than half of said supporting crossbar. The boards are fixed to the supporting or bearing crossbars by means of fastening dowels which extend partially in crossbars, partially in shelf boards at 45° angle relative to horizontal plane.

A shelf assembly of the invention applies excellently to be manufactured exclusively and completely from wood, the construction requiring no metal fasteners at all. The shelf assembly is extremely sturdy, the set of shelves can be built from elements, such as uprights, supporting crossbars, stringers and fastening dowels which join the shelf boards and uprights together for a free-standing and sturdy assembly. Whenever desired, the shelves can be disassembled into and likewise assembled from its elements easily. Dismounting of the shelf assembly can be effected manually. As the shelf assembly is loaded, said shelf boards, fastening dowels and supporting crossbars as well as uprights lock themselves even more rigidly together, in other words, loading of the shelf assembly increases the stability of said assembly.

DESCRIPTION OF THE DRAWINGS

The invention will now be explained in detail by means of a work example with reference made to the accompanying drawing, in which.

DESCRIPTION OF THE ILLUSTRATED EMBODIMENT

Figure 1:
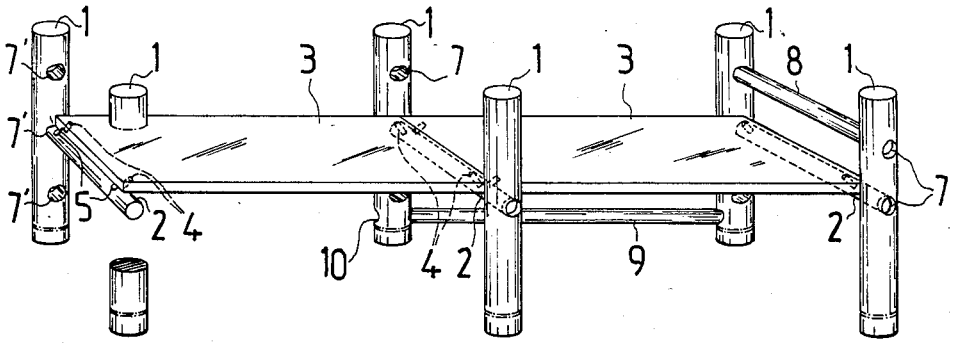
FIG.1 shows one shelf assembly of the invention inclined from above.

The shelf assembly shown in FIG. 1 comprises a support frame consisting of uprights 1 joined pairwise together by supporting crossbars 2. Upon said supporting crossbars 2 are placed elongated, rectangular shelf boards, the bars extending crosswise below said shelf boards. As viewed from above, the uprights 1 are positioned to form a rectangle, the supporting crossbars are parallel, horizontal and placed side by side. According to the invention, shelf boards 3 are fastened endwise to supporting crossbars 2 by means of fastening dowels 4 by fitting said fastening dowels in slots formed in the crossbars and shelf boards. The slots in crossbars 2 open at 45° angle obliquely upward perpendicularly to the crossbars, while the slots in a shelf board open correspondingly at 45° angle obliquely downward, substantially perpendicularly to the ends of a board. Thus, as the fastening dowels 4 are fitted in the slots of said supporting crossbars at 45° angle relative to horizontal plane, said dowels extend obliquely upward into slots 6 formed in the bottom surface of a shelf board to be positioned on a supporting crossbar joining these shelf boards and supporting crossbars together for a solid assembly. Due to the inclined attachement of the fastening dowels to the supporting crossbars and shelf boards, loading on a shelf creates tension between the slots 5 made in fastening dowels 4 and supporting crossbars as well as slots 6 made in shelf boards and leads to the wedging of fastening dowels in said slots in a manner that the assembly is reinforced as a result of loading. Thus, the stability of such a structure is very good. Uprights 1 are joined together in the longitudinal direction of a shelf, i.e. perpendicularly to supporting crossbars 2 by means of stringers 9 fitted in slots 10 made in the uprights.

Figure 2:
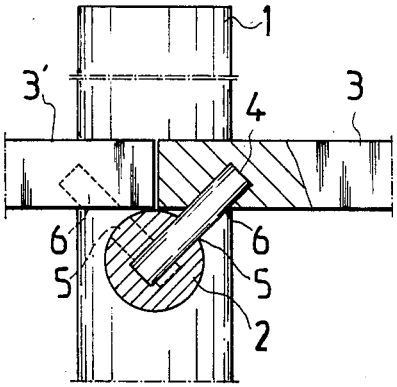
FIG. 2 shows fastening of shelf boards to supporting crossbars in the shelf assembly of FIG. 1 in partial section and viewed from the end of a crossbar.

In FIG. 2 a shelf assembly of the invention is shown viewed from the end, the supporting crossbar being cut off and the other shelf board partially cut away. The supporting crossbar is circular in cross-section, fitted in the circular slot in upright 1 (covered in the figure behind crossbar). Supporting crossbar 2 is provided with drilled holes 5, 5' perpendicularly to the surface of a crossbar and at 90° angle relative to each other. Shelf board 3 is placed upon crossbar 2 in a manner that the end of a board covers no more than half of a crossbar as viewed from the end of the latter, a fastening dowel 4 extending into said slot in the crossbar and into the aligning slot made in shelf board 3 thus securing the shelf board to said supporting crossbar. Upon said supporting crossbar, to rest thereon, is also placed the end of another shelf board 3', which is fastened endwise relative to the first shelf board. The latter shelf board 3' is secured to a crossbar by means of a similar dowel joint (in the figure said dowel has been removed for illustrating the construction) as the preceding shelf board. The top surface and end of shelf boards 3, 3' are perfectly intact in FIG. 2, in other words, they have no slots, recesses or any fasteners or other members. The shelf assembly offers an ideal stand for displaying and showing e.g. clothes.

Figure 3:
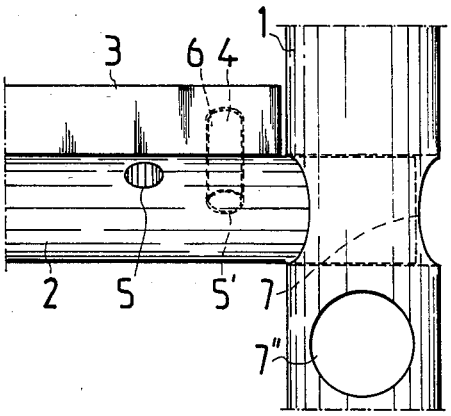
FIG. 3 shows the coupling of elements as viewed from the end of a shelf board.

FIG. 3 shows the shelf assembly of FIGS. 1 and 2 viewed from the end of a shelf board 3. According to the figure, a slot 6 (shown by dash lines) made in shelf board 3 and a fastening dowel (also shown by dash lines) fitted in said slot are perpendicular to the boards as viewed from the end thereof. As viewed from the end of a supporting crossbar, the slots 5, 5' (the latter shown by dash lines and partially hidden behind crossbar) made in supporting crossbar 2 are at 90° angle relative to each other according to FIG. 2 and in the longitudinal direction of a crossbar they are a certain transition distance from each other; this transition distance may be of a desired length, e.g. 0–10 mm or more.

The purpose of crossbars 2 is to serve as a support frame for shelf boards 3 and to couple the uprights pairwise together, as shown in FIG. 1. As the load on top of a shelf board increases, said crossbars 2 flex somewhat bending downwards in the middle, which makes them wedge firmly into the uprights fastening them together even more rigidly than before. The assembly may be provided with crossbars similar to supporting crossbars 2, e.g. a crossbar 8 in FIG. 1, which provides a sliding stop at the end of and above a shelf board. Auxiliary crossbars 8 can also be used to reinforce the assembly or to serve as suspension bars e.g. for clothes to be displayed.

The purpose of fastening dowels 4 is to secure shelf boards 3 to supporting crossbars 2. By virtue of the inclined 45° angle of joint of the invention, a loaded shelf board simply cannot disengage from a supporting crossbar, with the load from above urging a fastening dowel for firmer grip in the slots 5, 6 of a supporting crossbar and shelf board. When attached to a supporting crossbar and shelf board, a fastening dowel prevents rotation of a crossbar. The surfaces of supporting crossbars 2 exposed to compression and tensile stress, i.e. the top and bottom surfaces of said crossbars, are intact so slots 5 lower the flexural strength of crossbars as little as possible.

If desired, the assembly may be provided with accessories, e.g. a backing panel, shelf board edges etc. according to any given application or purpose. A plurality of shelf boards can be superimposed spaced from each other with supporting crossbars fitted in slots provided in uprights one above and spaced from another, e.g. slots 7' in FIG. 1, the left-hand upright. Shelf boards can also be joined endwise as shown in FIG. 2 for extending an array of shelves according to purpose and application. It should be noted that one upright may be provided with a plurality of slots 7, 7'' staggered from each other as shown in FIG. 3, whereby an upright 1 may include a plurality of shelf boards coming from various directions and staggered e.g. 90°. Thus, the shelf assembly of the invention is excellently suitable for setting up very sturdy shelves which intersect and join each other angularly. If desired, it is possible to install between two superimposed shelves an intermediate plate which is fitted upright and forms a partition for the shelf. It is possible that supporting crossbars 2 join uprights 1 just by one end thereof, in which case a shelf board 3 forms a shelf, supported by one lateral edge to uprights 1 and open at its other edge.

The work example is intended to illustrate the invention without limiting it in any way.

I claim:

1. A shelf assembly, comprising a pair of spaced upright side members, a generally horizontal cross bar connecting said side members, a shelf board disposed between the side members and supported on the cross bar, said cross bar having a first generally radial opening extending at an angle of about 45° to the horizontal and the lower surface of said shelf board having a second opening extending at an angle of about 45° to the horizontal and aligned with said first opening, said second opening extending only partially through said shelf board, and a dowel disposed within said aligned openings.

2. The shelf assembly of claim 1, including a plurality of corresponding pairs of spaced upright side members and a crossbar for each of said corresponding pairs of side members, each upright side member having a hole, the ends of each crossbar being received in said holes of corresponding pair of said side members.

3. The shelf assembly of claim 2, wherein an end of said shelf board covers approximately half the width of said crossbar, and said shelf assembly includes a second shelf board having an end mounted in abutting relation with said end of said first shelf board and covering approximately half of the width of said crossbar, said crossbar having a third opening disposed at an angle of about 45° to the horizontal and located at 90° with respect to said first opening, and the lower surface of said second shelf board having a fourth opening disposed at an angle of 45° with respect to the horizontal and aligned with said third opening, and a second dowel disposed in the aligned third and fourth openings to connect said second shelf board to said crossbar.

* * * * *